US005928441A

United States Patent [19]

Izawa et al.

[11] Patent Number: 5,928,441

[45] Date of Patent: Jul. 27, 1999

[54] HOT ROLLING METHOD OF STEEL PRODUCTS AND HOT ROLLING ROLL FOR STEEL PRODUCTS

[75] Inventors: Masaru Izawa; Yoshiaki Kusaba, both of Kobe; Kenji Tsubouchi, Takarazuka, all of Japan

[73] Assignee: Sumitomo Metal Industries, Ltd., Osaka, Japan

[21] Appl. No.: 08/809,561

[22] PCT Filed: Aug. 12, 1996

[86] PCT No.: PCT/JP96/02287

§ 371 Date: Mar. 24, 1997

§ 102(e) Date: Mar. 24, 1997

[87] PCT Pub. No.: WO97/06900

PCT Pub. Date: Feb. 27, 1997

[30] Foreign Application Priority Data

Aug. 15, 1995 [JP] Japan ..... 7/208221
Feb. 14, 1996 [JP] Japan ..... 8/26522

[51] Int. Cl.[6] ..... C23C 22/00

[52] U.S. Cl. ..... 148/252; 72/236; 148/277; 148/287; 428/472.2; 492/1; 492/58; 492/60

[58] Field of Search ..... 148/252, 277, 148/287; 428/472.2; 72/236; 492/1, 58, 60

[56] References Cited

U.S. PATENT DOCUMENTS 2,105,015 1/1938 Singer ..... 148/252
2,835,616 5/1958 Rausch et al. ..... 148/252

FOREIGN PATENT DOCUMENTS 57-112905 7/1982 Japan .
57-165115 10/1982 Japan .
58-202905 11/1983 Japan .
59-125202 7/1984 Japan .
60-21111 2/1985 Japan .
63-41646 8/1988 Japan .
3-25241 4/1991 Japan .
4-4045 1/1992 Japan .
5-212419 8/1993 Japan .

*Primary Examiner*—David A. Simmons
*Assistant Examiner*—Robert R. Koehler
*Attorney, Agent, or Firm*—Burns, Doane, Swecker & Mathis, L.L.P.

[57] ABSTRACT

A hot rolling method of steel products comprises rolling steel products while forming a film of an oxalate (such as iron oxalate, calcium oxalate and the like) on the roll surfaces which have contact with the steel products to be rolled and a hot rolling roll for steel products which has an oxalate film on the roll surfaces having contact with the steel products to be rolled. The oxalate film is effective in preventing steel products, particularly stainless steel products, from seizing between the rolls and the steel products to be rolled, preventing wear of the rolls, and preventing the deterioration of both the rolls and the steel products, when the steel products are subjected to hot rolling.

20 Claims, 14 Drawing Sheets

| | |
|---|---|
| Test Piece [1] | adamite steel<br>diameter: 50mm<br>thickness: 10mm<br>height: 30mm |
| Test Piece [2] | SUS 304<br>diameter: 50mm<br>height: 60mm |
| Test conditions | Temperature: 800℃<br>Load: 980N<br>Number of Rotations of Test Piece [2]: 10rpm<br>Slip Ratio: 100% |

| | |
|---|---|
| Test Piece [1] | high speed steel<br>diameter: 100mm<br>height: 30mm |
| Test Piece [2] | SUS 304<br>diameter: 110mm<br>height: 10mm |
| Test conditions | Temperature: 800℃<br>Load: 980N<br>Number of Rotations of Test Pieces [1] and [2]: 10rpm<br>Slip Ratio: 9% |

| | |
|---|---|
| Test Piece [1] | adamite steel<br>diameter: 100mm<br>height: 30mm |
| Test Piece [2] | SUS 304<br>thickness: 100mm<br>width: 20mm<br>length: 100mm |
| Test conditions | Temperature: 800℃<br>Load: 980N<br>Number of Rotations of Test Piece [1]: 10rpm<br>Slip Ratio: 100% |

| | |
|---|---|
| Material for Roll | Nickel Grain Iron |
| Material to be Rolled | SUS 304 |
| Rolling Temperature | 750～800℃ |
| Product Size | H200×100×5.5/8 |
| Total Amount of Rolling | 50 tons |

FIG. 19

| | |
|---|---|
| Material for Roll | Nickel Grain Iron |
| Material to be Rolled | SUS 304 |
| Rolling Temperature | 750～800℃ |
| Product Size | H200×100×5.5/8 |
| Total Amount of Rolling | 100 tons |

HOT ROLLING METHOD OF STEEL PRODUCTS AND HOT ROLLING ROLL FOR STEEL PRODUCTS

TECHNICAL FIELD

The present invention relates to a method for the hot rolling of steel products and also to a hot rolling roll for steel products. In particular, the present invention relates to a hot rolling method of steel products and a hot rolling roll for steel products, both of which are effective in preventing steel products, such as steel bars, steel sections, steel plates, steel sheets in coil, steel tubes, steel flats and steel wire rods, particularly stainless steel products, from seizing between the rolls and the steel products to be rolled, preventing wear of the rolls, and preventing the deterioration of both the rolls and the steel products, when these steel products are subjected to hot rolling.

TECHNICAL BACKGROUND

In recent years, a diversity of steel products has been demanded, which frequently requires the hot rolling of steel products under severe conditions. The hot rolling under severe conditions often causes the seizure between the rolls for hot rolling (i.e. hot rolling rolls constituted essentially of iron-based materials and hereinafter referred to simply as "rolls") and the steel products to be rolled. As the wear of the rolls advances, the rolls suffer deterioration on the surfaces, thus, presenting the problem that the deterioration of the rolls transfers to the surface of the steel products being rolled. For instance, where H beams are hot rolled by means of a universal mill, the seizure occurs between the rolls and the H beams especially at a portion where a sliding velocity relative to the H beams becomes great or at a portion where a normal stress becomes locally high, thereby causing problems. To avoid this, it is inevitable that frequent care must be done for the rolls and the rolled steel products. This takes uncountable time and cost.

Especially, where stainless steel H beams are hot rolled, the seizure is very likely to occur. The countermeasures therefore have been extensively studied from different angles. For instance, high chromium cast iron or high speed steels have been developed from the standpoint of materials for the rolls. However, when these materials are used as the rolls, it is not always possible to completely prevent the seizure. At present, for the prevention of the seizure, lubricants such as graphite compounds have to be used.

To prevent the seizure, an attempt has been made to treat the roll surfaces. For instance, a roll is covered on the surface with Cr by a chromium-plating method, TiN by a CVD method (i.e. a chemical vapor deposition method), and TiC by a PVD method (i.e. a physical vapor deposition method).

However, the time and cost required for these treatments are vast. When using the rolls which have been subjected to the above-mentioned surface coating treatments, the film on the roll is liable to peel off under such severe conditions as of the hot rolling. In this sense, any stable anti-seizing property and wear resistance have not been developed to date.

Extensive studies have also been made on lubricants for hot rolling rolls. Among known lubricants, organic lubricating oils often undergo shortage of oil film or combustion, so that satisfactory lubricating effects cannot be expected. JP-A No. 5-212419 discloses a technique wherein graphite is deposited on roll surfaces as a lubricant by means of a combustion burner using a hydrocarbon fuel. The method proposed in this publication is certainly effective in preventing the seizure. However, the use of graphite has the problem that steel products to be rolled undergo "carburization" under hot (high temperature) conditions because of the use of graphite and that steel products to be rolled are apt to slip on rolling. In addition, the graphite particles scatter to worsen the working environment.

JP-B2 No. 3-25241 discloses a technique wherein, while a mixed liquid paint, composed of an anti-seizing agent, consisting of metal oxide powder and a binder is continuously supplied to and coated onto the peripheral surface of a disk roll-type guide shoe, steel products are pierced. The method proposed in this publication is effective in preventing the seizure. However, because the anti-seizing agent is fixedly deposited on the roll surface, water glass has to be used as the binder. If the above-mentioned mixed liquid paint is not uniformly coated onto the roll surface, surface depression takes place in the surface of the steel products being rolled, thereby causing the surface condition to be degraded. The metal oxide powder used as the anti-seizing agent does not dissolve in the water glass binder. If this powder is allowed to stand under conditions where it is mixed with water glass, it deposits or settles down. This may cause a coating nozzle to be clogged.

Studies have now been made on inorganic solid lubricants such as molybdenum disulfide and glass. Among these lubricants, some lubricants show good lubricity under high temperature conditions. However, like graphite, coating conditions and the removal of residual lubricants are difficult, with the attendant apprehension that an adverse influence is made on the product properties and the working environment. In addition, the lubricants act to lower the coefficient of friction, thus presenting the problem of slipping, which occurs during the course of the hot rolling.

On the other hand, it is known that calcium carbonate has a good effect as a solid lubricant. However, calcium carbonate is difficult to coat. When it is coated in the form of solid powder, dust generates to worsen the working environment. Like inorganic solid lubricants such as molybdenum disulfide and glass, calcium carbonate is difficult to dissolve in water, organic solvents and oils. If calcium carbonate is allowed to stand in the form of a mixture with water, organic solvents and oil, it tends to form a deposit. In order to keep the mixture in the best condition at the time of coating, it has to be stirred at all times.

Where steel products are subjected to cold working by various methods, it is usual to use a compound film such as of a phosphate, an oxalate and the like so as to enhance adherence and retention of a lubricant and also to prevent contact with tools, especially when the cold working is performed under such severe conditions that oil lubrication does not work effectively. The compound film is formed by pre-treatment and a soap lubricating film serving as a lubricant, both of which are used to lower the frictional force exerted between the tool and the material to be worked, thereby preventing the wear and seizure.

For instance, JP-B2 No. 4-4045 discloses a technique wherein a solution of a phosphate or an oxalate is fed onto the surface of a metal strip just prior to rolling to form a phosphate or oxalate film on the surface of the metal strip on the way of the cold working. The method proposed in this publication is effective in preventing seizure in cases where steel products are cold worked. However, it has little effect on preventing the seizure when steel products are hot rolled. This is because the phosphate or oxalate film is thermally decomposed when exposed to high temperatures ranging from 400~500° C. or above, so that it is not possible to stabilize the phosphate or oxalate film on the surface of a steel product being rolled at a high temperature of approximately 800° C. or above. Of course, scales are formed on the surface of the steel product which is being heated for the hot rolling, under which even if a phosphate or oxalate film is formed on the surface of the steel product, any anti-seizing effect cannot be expected. In the technique set out in the above-indicated publication, a solution of a phosphate or an oxalate is directly supplied to the surface of the steel product. If water which is the most inexpensive among the solvents is employed and a salt which is sparingly soluble in water (e.g. calcium oxalate and the like) is used, the sparingly soluble salt becomes clogged in pipes and the nozzle. Such an aqueous solution of the salt may not be supplied to the surface of the steel product even if the supply is desired. Thus, the technique disclosed in JP-B2 No. 4-4045 is applicable to cold working of steel products, but cannot be applied to hot working.

DISCLOSURE OF THE INVENTION

An object of the present invention is to provide a method for the hot rolling of steel products and also to a hot rolling roll for steel products wherein the seizure between the rolls and the steel products to be rolled which may occur during the hot rolling of the steel products, in particular, stainless steel products, the wear of the rolls, and the deterioration of both the rolls and the steel products can be effectively prevented.

The subject matter of the present invention resides in; (1) a method for the hot rolling of steel products which comprises forming a seizure-preventing oxalate film on the roll surfaces which have contact with the steel products to be rolled, by immersing the rolls prior to hot rolling in an aqueous oxalic acid solution, coating or spraying an aqueous oxalic acid solution over the rolls, or applying, as a part or all of the roll cooling water during the course of hot rolling, both an aqueous oxalic acid solution or an aqueous solution containing a water-soluble oxalate and an aqueous solution containing a water-soluble alkaline-earth metal compound, such as a calcium compound, and subjecting the steel products to hot rolling, and; (2) a hot rolling roll for steel products, which comprises forming an oxalate film on the roll surfaces which have contact with the steel products to be rolled.

As described in detail, later in this specification, according to the present invention, the seizure between the rolls and the steel products to be rolled which may occur during the course of the hot rolling can be effectively prevented. This prevents not only operation troubles occurring at the time when so-called "common steels" such as carbon steels and low alloy steels are rolled, but also seizing troubles with stainless steels and, in particular, stainless steel H beams, where problems are frequently experienced during the rolling. In addition, mending or repairing of the rolls and the products can be lessened, and a working efficiency can be improved by reducing a frequency of roll substitution, enabling the life of a large-sized roll to be significantly prolonged.

The inventors of the present invention made intensive studies on the prevention of the seizure and the improvement of surface conditions or properties of rolled steel products (products) in case where steel products are hot rolled with rolls composed of iron-based stocks by use of various types of aqueous solutions as a lubricant. As a result, the following important information was obtained.

(1) The oxalate film formed on the roll surface can prevent the seizure and can remarkably improve the surface conditions of final products.

(2) Where the oxalates used as the film are ones of the following types (a)~(c), the effect of (1) above has been recognized.

(a) Iron oxalate.

(b) Oxalates of alkaline-earth metals (e.g. calcium oxalate, barium oxalate and the like).

(c) Mixed salts consisting of iron oxalate and alkaline-earth metal oxalates.

(3) When using the film of the above-mentioned oxalate, no problem is involved in that the coefficient of friction becomes too low, thereby causing slippage. In addition, the anti-seizing effect is great.

(4) When rolls for hot rolling are treated under appropriate conditions with an aqueous oxalic acid solution or an aqueous solution containing a water-soluble oxalate (e.g. an alkali metal oxalate, ammonium oxalate and the like), and an aqueous solution containing a water-soluble alkaline-earth metal compound (e.g. a calcium compound, a barium compound and the like), the above-mentioned film of the oxalates (a)~(c) can be formed on the roll surfaces.

It should be noted that the term "aqueous solution containing a water-soluble alkaline-earth metal compound" used herein means "an aqueous solution containing at least 20 ppm or over of alkaline-earth metal ions".

Since a similar effect is obtained using any of "calcium", "barium" and the like for "an alkaline-earth metal", "calcium" is used for the following illustration as typical of "alkaline-earth metals" only for convenience's sake.

(5) On contact of calcium oxalate, used as an oxalate film, with hot steel products to be rolled, it is thermally decomposed into calcium carbonate.

As has already been stated, calcium carbonate has a good effect as a solid lubricant. The removal of calcium carbonate is easier than other types of inorganic solid lubricants such as molybdenum disulfide and glass. However, when calcium carbonate is coated in the form of powder, dust undesirably generates, thus worsening the working environment. Additionally, calcium carbonate is sparingly soluble in water, organic solvents and oils. When calcium carbonate is allowed to stand in a mixed state with water, organic solvents and oils, it settles down or deposits, thereby causing pipes or the nozzle to be clogged.

In contrast, when calcium carbonate is produced by thermal decomposition of calcium oxalate which has been in contact with hot steel products to be rolled, there arises no problem with worsening the working environment and clogging pipes or the nozzle with calcium carbonate.

(6) Although calcium oxalate used as an oxalate film has relatively weak adherence to rolls, the deposition of the calcium oxalate film alone exhibits a great anti-seizing effect. This is because calcium oxalate which is in the form of particles having a diameter of 0.3~20 $\mu$m enters recessed portions of roll surfaces and deposits on the surfaces to form a film, thereby preventing the metallic contact between the hot steel products to be rolled and the rolls.

Where a mixed film consisting of iron oxalate and calcium oxalate is formed on roll surfaces, calcium oxalate [11] as protected with iron oxalate [12] is deposited satisfactorily on a roll [13] as shown in FIG. 1, ensuring a greater anti-seizing effect.

(7) Of oxalate films, an iron oxalate film can be very readily repaired by spraying or coating, for example, an aqueous solution of oxalic acid even if the film is peeled off during the course of the hot rolling.

(8) Where a film of a mixture consisting of iron oxalate and calcium oxalate is formed on the roll surfaces, the iron oxalate is repaired so readily that the calcium oxalate protected with iron oxalate can also be repaired readily.

(9) The formation of the oxalate film on the roll surfaces is performed at costs much lower than the surface coating effected by a plating method, a CVD method or a PVD method.

According to the method and the roll of the present invention, when an oxalate film (e.g. at least one film selected from an iron oxalate film and a calcium oxalate film) is formed on roll surfaces, for example, by a procedure of any of (d)~(f) set out below, the seizure between the rolls and the steel products to be rolled can be prevented, thereby significantly improving the roll life (i.e. the time before the roll is changed by a fresh one) and the surface condition of the products.

(d) Prior to the use of rolls for hot rolling, the roll surfaces which have contact with steel products to be rolled are appropriately treated with an aqueous oxalic acid solution.

(e) An aqueous oxalic acid solution is employed as a part or all of the cooling water for rolls during hot rolling.

(f) Cooling waters from two lines are used for cooling for rolls being used for hot rolling. An aqueous oxalic acid solution or an aqueous solution containing a water-soluble oxalate (e.g. an alkali metal oxalate, ammonium oxalate and the like) is used as a part or all of the cooling water from one line, and an aqueous solution containing a water-soluble calcium compound is used as a part or all of the cooling water from another line.

If the oxalate film is formed according to the method of (f), a so-called "sparingly soluble-in-water" calcium carbonate is formed just on the roll surfaces, thus not involving any problem of clogging a nozzle for jetting the cooling water. In addition, calcium oxalate does not settle down in the cooling water.

The formation of a film on roll surfaces by the treatment of the rolls with an aqueous oxalic acid solution is based on the following formula (A);

$$Fe+C_2H_2O_4 \rightarrow FeC_2O_4+H_2 \quad (A).$$

In particular, where rolls are immersed in an aqueous oxalic acid solution or where an aqueous oxalic acid solution is coated onto or sprayed over rolls to deposit the oxalic acid thereon, iron is dissolved on the roll surfaces to generate hydrogen according to the following formulas (B)~(E), whereupon iron ion and oxalate ion react to produce $FeC_2O_4$. Thus $FeC_2O_4$ is produced and forms as a film which covers the roll surfaces.

$$Fe \rightarrow Fe^{2+}+2e^- \quad (B)$$

$$C_2H_2O_4 \rightarrow 2H^++C_2O_4^{2-} \quad (C)$$

$$2H^++2e^- \rightarrow H_2 \quad (D)$$

$$Fe^{2+}+C_2O_4^{2-} \rightarrow Fec_2O_4 \quad (E)$$

The iron oxalate film is thermally decomposed into iron oxide according to the formula (F) on contact with hot steel products to be rolled, and the iron oxide prevents the metallic contact between the steel products and the rolls.

$$FeC_2O_4 \rightarrow FeO+CO_2+CO \quad (F)$$

The formation of a calcium oxalate film is based on the reaction of the following formula (G);

$$C_2O_4^{2-}+Ca^{2+} \rightarrow CaC_2O_4 \quad (G)$$

At the time of the hot rolling of the steel products, the calcium oxalate contacts with the hot steel products, heated to approximately 800° C. or above and is converted into calcium carbonate, thus being effectively utilized as a solid lubricant and having set out herein.

$$CaC_2O_4 \rightarrow CaCO_3 \rightarrow CO \quad (H)$$

The CO generated above is exposed to the hot steel products, whereupon it readily converts into $CO_2$ as shown in the formula (I);

$$2CO \rightarrow C+CO_2 \quad (I)$$

It should be noted that even if, for example, ions such as $Na^+$, $K^+$, $Mg^{2+}$, $Cl^-$ and the like derived from oxalates and calcium compounds are contained in the cooling water for rolls, the formation of a desired oxalate film is not adversely influenced.

BRIEF DESCRIPTION OF THE DRAWINGS

FIG. 19 is a table showing other conditions of a line test using a rolling mill.

BEST MODE FOR CARRYING OUT THE INVENTION

Figures 1, 2:
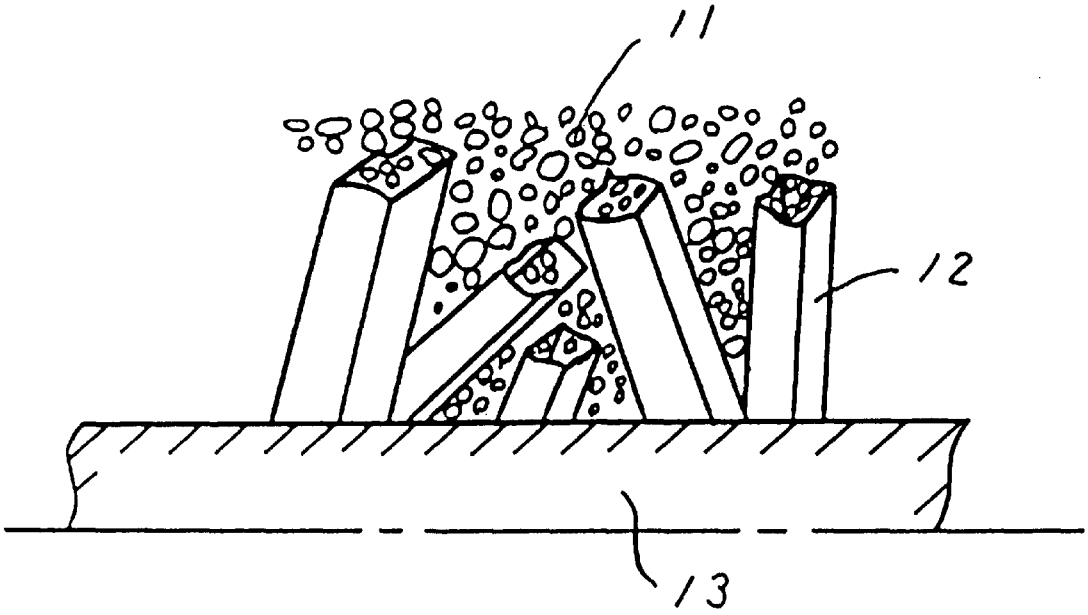
FIG. 1 is a schematic view showing the formation of an oxalate film on a roll surface.
FIG. 2 is a table showing friction test conditions for a "ring-disk system" used in Example 1.

In order to form an oxalate film within a short time on the roll surfaces which have contact with the steel products to be rolled, the concentration of an aqueous oxalic acid solution, an aqueous solution containing a water-soluble oxalate, and an aqueous solution containing a water-soluble calcium compound, the treating temperature for the respective solutions, the amount of the solution and the type of material for hot rolling rolls should be determined in the following manner.

(1) Concentration of an aqueous oxalic acid solution:

The concentration of an aqueous oxalic acid solution may not be critical. In order to form a desired film within a short time, however, it is preferred that the concentration is such that 10~100 g of oxalic acid ($C_2H_2O_4$) per 1 liter of water.

(2) Treating temperature of an aqueous oxalic acid solution at roll surfaces:

The treating (e.g. spraying) temperature of an aqueous oxalic acid solution at roll surfaces, at which an oxalate film is formed, is not critical. In order to form the film within a short time, however, the treating temperature should preferably be in the range of 20~90° C.

(3) Amount of an aqueous oxalic acid solution:

In order to form a desired oxalate film within a short time, it is preferable to treat the rolls with an aqueous oxalic acid solution in amounts described below.

Where the aqueous oxalic acid solution is sprayed or coated on roll surfaces, the aqueous oxalic acid solution having such a concentration described in (1) is sprayed or coated on the roll surfaces at such a treating temperature as described in (2) at a rate of 1 liter or more/minute per 1 $m^2$ of the roll surfaces.

If the rolls are immersed in the aqueous oxalic acid solution, it is desirable to immerse them in an aqueous oxalic acid solution having a concentration as described in (1) at 20~90° C. in an amount of 1 liter or more/minute per 1 $m^2$ of the roll surfaces.

(4) Aqueous solution containing a water-soluble oxalate:

The type of water-soluble oxalate is not critical. For example, alkali metal oxalates, ammonium oxalate and the like may be used. The concentration of the aqueous solution containing a water-soluble oxalate may also not be critical. In order to form a desired film within a short time, however, the concentration in the aqueous solution should preferably be 10~100 g of a water-soluble oxalate per 1 liter of water, as before.

(5) Treating temperature of an aqueous solution containing a water-soluble oxalate at the roll surfaces:

An aqueous solution containing a water-soluble oxalate and an aqueous solution containing a water-soluble calcium compound react on the roll surfaces to form a film of calcium oxalate. The treating (e.g. spraying) temperature of the aqueous solution containing a water-soluble oxalate at the roll surfaces at which the film is formed is not critical. However, in order to form a desired film within a short time, the treating temperature should preferably be in the range of 20~90° C.

(6) Amount of an aqueous solution containing a water-soluble oxalate:

In order to form a desired oxalate film within a short time, the aqueous solution having such a concentration as described in (4) is preferably used to treat the roll surfaces at such a treating temperature as defined in (5) at a rate of 1 liter or more/minute per 1 $m^2$ of the roll surfaces.

(7) An aqueous solution containing a water-soluble calcium compound:

The type of water-soluble calcium compound is not critical. For instance, chlorides and nitrates are acceptable. The aqueous solution containing a water-soluble calcium compound may be "an aqueous solution containing at least 20 ppm or more of calcium ions", and its concentration may not be critical. However, in order to form a desired film within a short time, the aqueous solution should preferably have a concentration of a calcium compound of 10~100 g per 1 liter of water.

(8) Treating temperature of an aqueous solution containing a water-soluble calcium compound at the roll surfaces:

An aqueous solution containing a water-soluble calcium compound, and an aqueous oxalic acid solution or an aqueous solution containing a water-soluble oxalate react on the roll surfaces to form a film of calcium oxalate. The treating (e.g. spraying) temperature of the aqueous solution containing a water-soluble calcium compound at the roll surfaces, at which the film is formed, is not critical. However, in order to form a desired film within a short time, the treating temperature should preferably be in the range of 20~90° C.

(9) Amount of an aqueous solution containing a water-soluble calcium compound:

For the formation of a desired oxalate film within a short time, an aqueous solution having such a concentration as described in (7) is preferably used to treat the roll surfaces at such a treating condition as described in (8) at a rate of 1 liter/minute per 1 $m^2$ of the roll surfaces.

Using the conditions of above-mentioned (1)~(9), the films of oxalates can be formed within a short time, e.g. the film of iron oxalate can be formed with a thickness of 10~25 μm, and the film of calcium oxalate in the form of particles having a size of approximately 0.3~20 μm can be formed with a thickness of 80~100 μm. A preferred thickness of the iron oxalate film is in the range of 15~20 μm. Likewise, a preferred size of the calcium oxalate particles is in the range of 0.3~5 μm.

(10) Material for the rolls:

The type of material for the rolls is not critical so far when an iron-based material is used. In order to form a desired film within a short time, it is preferable to use a material which contains 70 wt % or more of Fe. Examples of such a material include adamite steel, ductile cast iron, nickel grain iron, high chromium cast iron, high speed steels and the like.

If the above-mentioned requirements (1)~(10) are satisfied, an iron oxide film from desired oxalate films can be formed within a treating time of one second to 60 minutes, and the calcium oxalate film can be formed within a very short time, one second or less.

In order to further shorten the formation time of oxalate films and in particular, an iron oxalate film, and also to increase the film thickness, it is preferable to add sodium thiosulfate and the like as a reaction accelerator to an aqueous oxalic acid solution.

The hot rolling method of steel products according to the present invention can be carried out by appropriately defining the above-mentioned requirements (1)~(3) and (10) and hot rolling steel products by use of the rolls immersed in an aqueous oxalic acid solution or the rolls sprayed or coated with an aqueous oxalic acid solution. Alternatively, the hot rolling method of steel products, according to the present invention, may be carried out by appropriately defining the requirements above-mentioned (1)~(10), providing an aqueous oxalic acid solution or an aqueous solution containing a water-soluble oxalate, and an aqueous solution containing a water-soluble calcium compound as a part or all of the roll cooling water, and hot rolling steel products while jetting these aqueous solutions over the surfaces of rolls being used for hot rolling, from nozzles in separate lines. According to this hot rolling method, the seizure between the rolls and the steel products to be rolled, the wear of the rolls and the deterioration of both the rolls and the steel products can be avoided.

The hot rolling roll for steel products, according to the present invention, can be readily obtained by appropriately defining the above-mentioned requirements (1)~(3) and (10) and immersing the rolls in an aqueous oxalic acid solution, or spraying or coating an aqueous oxalic acid solution on the rolls. Alternatively, the hot rolling roll for steel products, according to the present invention, may be readily obtained by appropriately defining the above-mentioned requirements (1)~(10), and providing an aqueous oxalic acid solution or an aqueous solution containing a water-soluble oxalate, and an aqueous solution containing a water-soluble calcium compound as the roll cooling water, and jetting these aqueous solutions over roll surfaces, from nozzles in separate lines.

EXAMPLES

The present invention is described concretely using examples, which should not be construed as limiting the present invention thereto.

Example 1

Various types of iron-based roll materials for hot rolling were, respectively, treated with an aqueous oxalic acid solution to check how an iron oxalate film was formed. In particular, test pieces cut out from adamite steel, ductile cast iron and nickel grain iron were each finish machined on the surfaces and cleaned, or were each finish machined, polished with #80~#180 sandpapers and cleaned. Thereafter, each piece was immersed for 10 minutes in an aqueous oxalic acid solution which contained 30 g of oxalic acid ($C_2H_2O_4$) per 1 liter of water and which was heated to 80° C. The amount of the solution per 1 $m^2$ for a surface area of each test piece was 10 liters.

Thereafter, the iron oxalate film formed on the surface of each test piece was observed through a scanning electron microscope and also through an optical microscope. The thickness of the iron oxalate film was measured by use of an electromagnetic thickness meter.

As a result, it was found; (1) that surface portions of each test piece, except for the surface carbide, were covered with dense crystals of iron oxalate ($FeC_2O_4$) having a length of 5~10 μm and; (2) that the thickness of the iron oxalate film formed on the surface of the test piece, was in the range of 15~20 μm.

Figure 3:
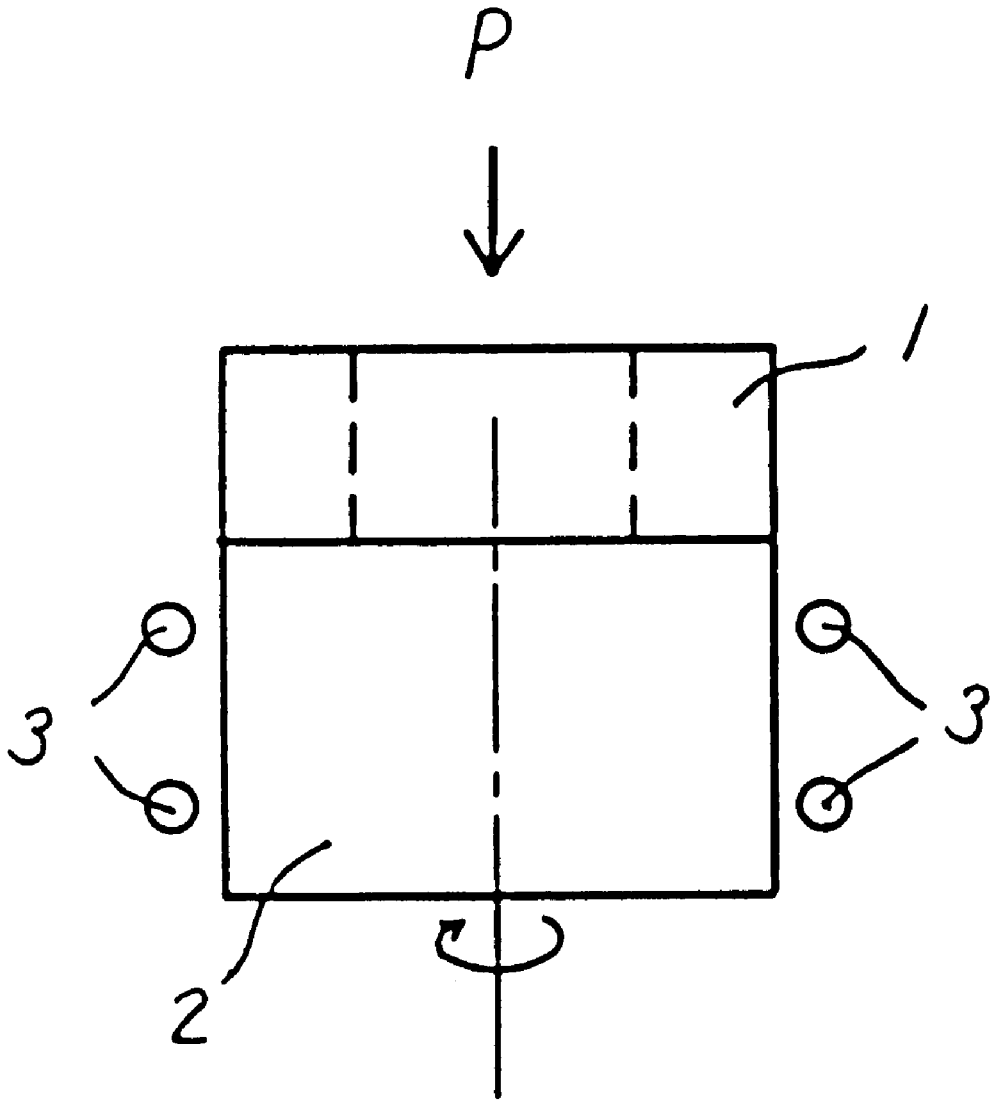
FIG. 3 is a view showing a method of evaluating a friction characteristic according to a "ring-disk system" used in Example 1.

The friction characteristic of the iron oxalate film was evaluated under conditions indicated in FIG. 2 according to a procedure shown in FIG. 3. In FIG. 3, a test piece [1] (made of adamite steel) corresponding to a roll was provided as a ring. While a disk of a test piece [2] (made of SUS 304) corresponding to a steel product to be rolled was rotated, it was heated to a test temperature (800° C.) by means of an induction heating device (a heating coil [3] alone shown in FIG. 3). The ring of test piece [1] was forced against the disk of test piece [2] at a load of P (980 N). This test device is a so-called "ring-disk system". According to this test, the anti-seizing property of a film could be assessed.

In order to ensure the accuracy with respect to the evaluation results of the friction characteristic of the film formed on the roll surfaces, a test corresponding to the method of the present invention was performed as follows. The friction face (surface) of the test piece [1] was polished with #180 sandpaper and then cleaned, followed by testing after formation of an iron oxalate film on the thus cleaned surface. For a comparative test corresponding to a prior conventional rolling method, the friction face (surface) of the test piece [1] was polished with #180 sandpaper and cleaned, but the film of iron oxalate was not formed.

The "slip ratio" in the test conditions of FIG. 2 was determined such that when the rotating speeds of the test pieces [1] and [2] were, respectively, taken as $V_1$ and $V_2$, the slip ratio (%)=100 $(V_2-V_1)/V_2$.

Figure 4B:
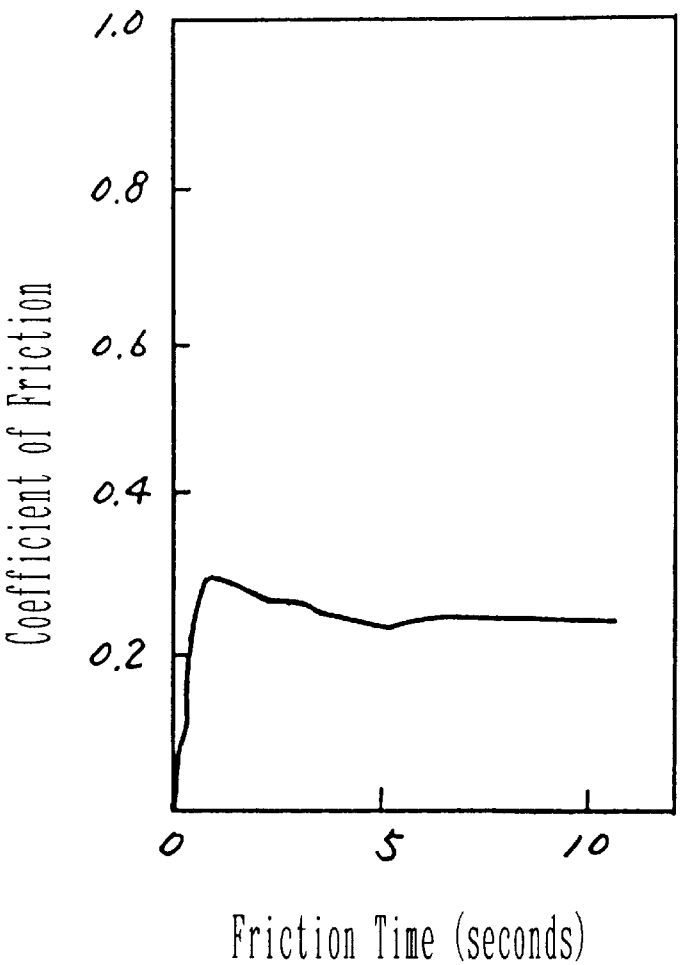
FIG. 4B is a graph showing the results of the evaluation of a friction characteristic in the friction test for Example 1 where the test piece corresponding to a roll has been formed with the film of iron oxalate as an oxalate film.
Figure 4A:
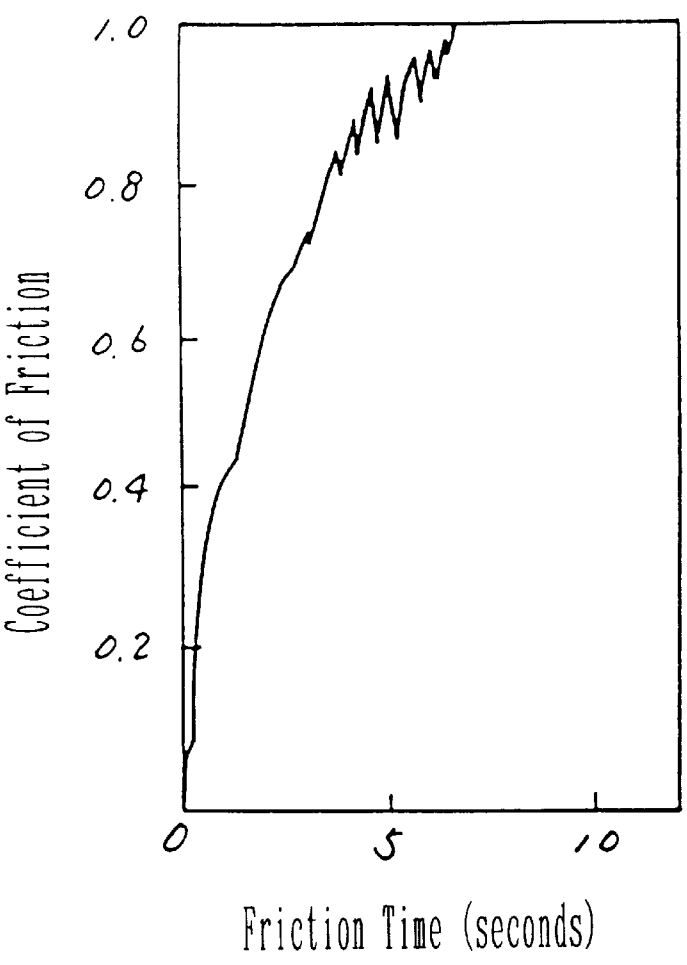
FIG. 4A is a graph showing the results of the evaluation of a friction characteristic in the friction test for Example 1 where the test piece corresponding to a roll has not been subjected to the formation of any film.

In FIGS. 4A and 4B, the results of the friction test conducted under the above-stated conditions are shown. FIG. 4A shows the results of the comparative test where the test piece [1] corresponding to a roll was not subjected to the formation of any film. FIG. 4B shows the results of the evaluation of the friction characteristic in the test of the present invention method wherein the test piece [1] was formed with the film of iron oxalate as an oxalate film.

In the case of the comparative method (FIG. 4A), the seizure took place violently from immediately after commencement of the frictional contact. In the method of the present invention wherein the test piece was formed with the film of iron oxalate on the surface thereof (FIG. 4B), it is apparent that the seizure was suppressed from occurring.

Example 2

Figures 5, 6:
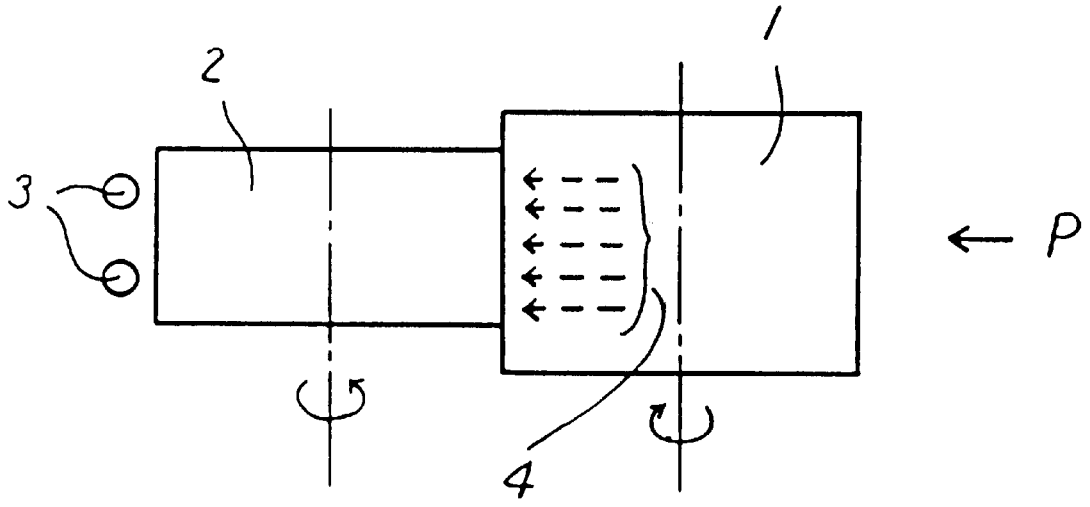
FIG. 5 is a view showing a method of evaluating a friction characteristic according to a "disk-disk system" used in Example 2.
FIG. 6 is a table showing friction test conditions of a "disk-disk system" used in Example 2.

In order to evaluate the friction characteristic of a film in a state close to that of a rolling mill, while rotating, according to a device shown in FIG. 5, a test piece [2] (in the form of a disk made of SUS 304) corresponding to a steel product to be rolled, it was heated to a test temperature (800° C.) by means of an induction heating device (a heating coil [3] alone shown in FIG. 5). A test piece [1] (in the form of a disk made of high speed steel) corresponding to a roll was subjected to a friction test using a "disk-disk system" wherein the test piece [1] was forced against the test piece [2]. In this test, the test piece [1] was polished with #180 sandpaper, cleaned and subjected to a test in order to bring the test conditions close to those rolling conditions of a rolling mill.

With the test corresponding to the method of the present invention, an aqueous oxalic acid solution having a concentration of 50 g of oxalic acid ($C_2H_2O_4$) per 1 liter of water was provided as cooling water (roll cooling water) [4] for the test piece [1] corresponding to a roll. On the other hand, city service water was used as cooling water [4] in the comparative test corresponding to a prior conventional rolling method. In either case, the cooling water [4] was supplied in an amount of 0.1 liter per minute immediately before the frictional contact between the test pieces [1] and [2].

The friction test conditions are shown in FIG. 6. It should be noted that like the test conditions of FIG. 2, the "slip ratio" in the test conditions of FIG. 6 was determined such that when the rotating speeds of the test pieces [1] and [2] were, respectively, taken as $V_1$ and $V_2$, the slip ratio (%)= $100\ (V_2-V_1)/V_2$.

The results of the fiction test conducted under such conditions as set out above reveal that like the results of Example 1, with the comparative test, a great number of scores which seemed to result from seizure were observed in the friction surface from immediately after commencement of the frictional contact, and their occurrence became worse as the friction time passed.

In contrast, where the aqueous oxalic acid solution was used as cooling water according to the method of the present invention, no score was observed as would be observed in the comparative test. In this case, the thickness of the film of the oxalate (iron oxalate) formed on the surface is considered to be very thin, but no seizure was recognized in the friction surfaces. Accordingly, it is considered that iron oxalate film is formed between the test pieces [1] and [2], with which the seizure can be prevented.

Example 3

Figures 7, 8:
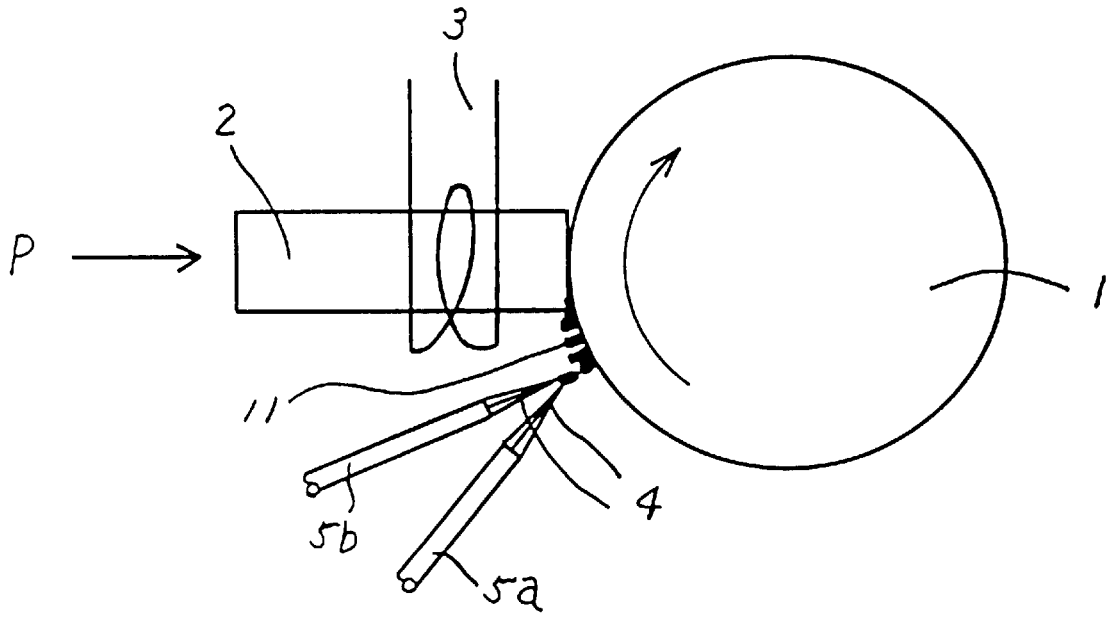
FIG. 7 is a table showing friction test conditions of a "cylinder-block system" used in Examples 3, 4, 5 and 6.
FIG. 8 is a view showing a method of evaluating a friction characteristic according to a "cylinder-block system" used in Examples 3 and 6.

In order to evaluate the friction characteristic of a film in a state close to that of a rolling mill, like Example 2, a system shown in FIG. 8 was used under conditions indicated in FIG. 7 to determine the characteristic. In particular, a test piece [2] (in the form of a block made of SUS 304) corresponding to a steel product to be rolled was heated to a test temperature (800° C.) by means of an induction heating device (a heating coil [3] alone shown in FIG. 8). Then, a friction test was conducted using a so-called "cylinder-block system" wherein test piece [2] was forced against test piece [1] (in the form of a cylinder made of adamite steel with the number of rotations of 10 r.p.m.) corresponding to a roll at a load of P (980 N).

It should be noted that the "slip ratio" in the test conditions of FIG. 7 was determined, such that when the rotating speeds of the test pieces [1] and [2] were, respectively, taken as $V_1$ and $V_2$ the slip ratio (%)=$100\ (V_1-V_2)/V_1$.

The reason why the shape of the test piece [1] in Example 3 is called "cylinder" and the shapes of the test piece [2] in Example 1, the test pieces [1] and [2] in Example 2, all of which are called "disk", which are similar to that of the test piece [1] in Example 3, is merely accepted to the usual practice in this convention of the friction tests.

In the test, the test piece [1] corresponding to an adamite steel roll was finish machined, polished with #180 sandpaper and cleaned, after which it was tested.

In the test, according to the method of the present invention, an aqueous oxalic acid solution having a concentration of 50 g of oxalic acid ($C_2H_2O_4$) per 1 liter of water, and an aqueous solution containing 50 g of calcium chloride per 1 liter of water were, respectively, fed as cooling water [4] for the test piece [1] from separate nozzles [5*a*] and [5*b*]. These aqueous solutions were, respectively, jetted at a rate of 0.05 liters/minute simultaneously at the same portion (position) immediately before the frictional contact between the test pieces [1] and [2].

On the other hand, in the comparative test corresponding to a prior conventional rolling method, city service water was used as the cooling water [4] and jetted from the nozzle [5*a*] at a rate of 0.1 liter per minute immediately before the frictional contact between the test pieces [1] and [2].

Figure 9B:
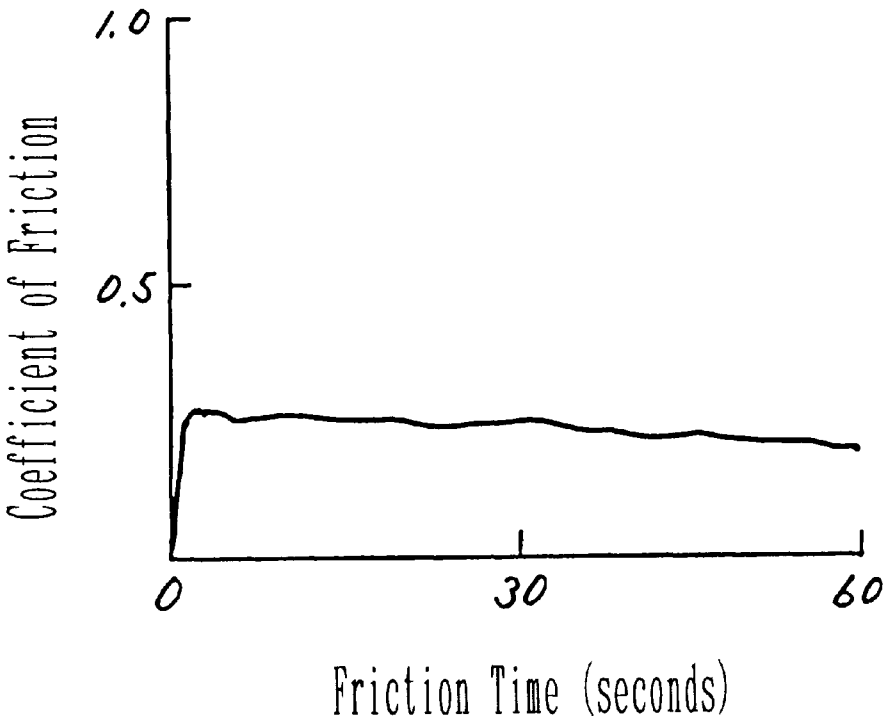
FIG. 9B is a graph showing the results of the evaluation of a friction characteristic in the friction test for Example 3 where the test piece corresponding to a roll has been formed with the film of a calcium oxalate as an oxalate film.
Figure 9A:
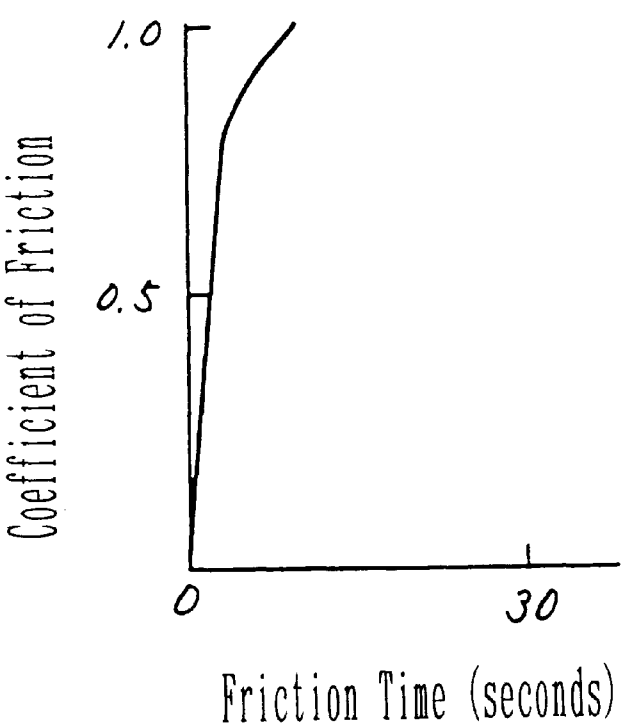
FIG. 9A is a graph showing the results of the evaluation of a friction characteristic in the friction test for Example 3 where the test piece corresponding to a roll has not been subjected to the formation of any film.

In FIGS. 9A and 9B, the results of the friction tests conducted under the above-stated conditions are shown. FIG. 9A shows the results of the comparative test where the test piece [1] corresponding to a roll was not subjected to the formation of any film. On the other hand, FIG. 9B shows the results of the evaluation of the friction characteristic in the test of the present invention method wherein a calcium oxalate film was formed on the test piece [1] as an oxalate film.

In the case of the comparative method (FIG. 9A), the seizure took place violently from immediately after commencement of the frictional contact. In the method of the present invention wherein the calcium oxalate film was formed on the surface of the test piece, the seizure could be prevented.

Example 4

Figure 10:
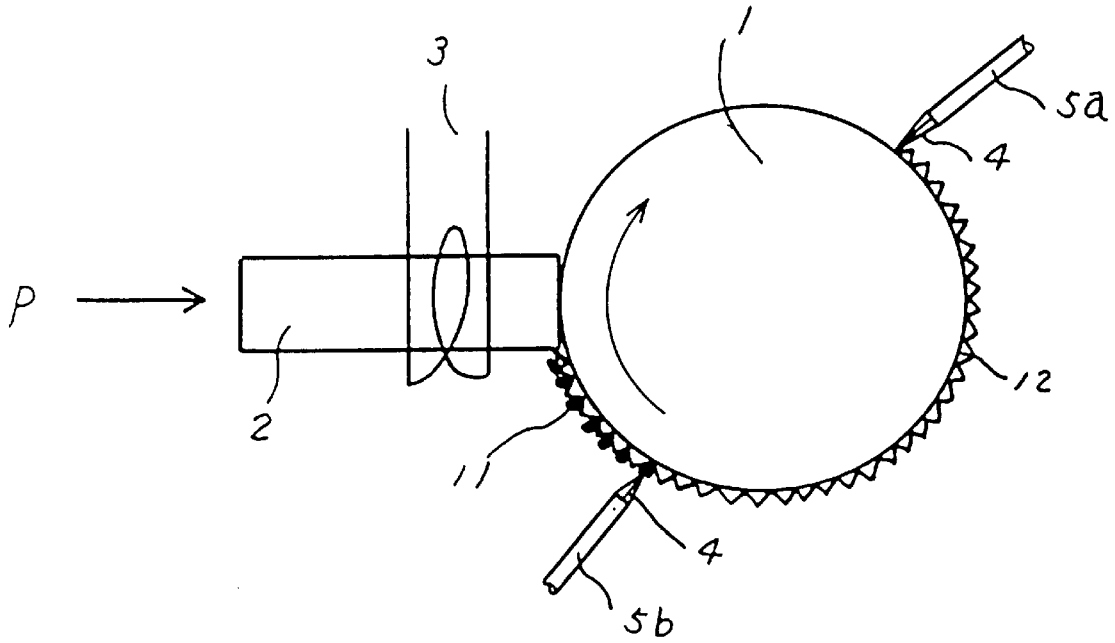
FIG. 10 is a view showing a method of evaluating a friction characteristic according to a "cylinder-block system" used in Example 4.

A friction test was conducted under conditions indicated in FIG. 7 using a "cylinder-block system" shown in FIG. 10. The test method and conditions were the same as those of Example 3 except that the feed of cooling water [4] for the test piece [1] corresponding to a roll was in a different way as set out below.

In the test, according to the method of the present invention, an aqueous oxalic acid solution having a concentration of 50 g of oxalic acid ($C_2H_2O_4$) per 1 liter of water was jetted from a nozzle [5*a*] at a rate of 0.05 liters per minute as cooling water [4] for the test piece [1]. Subsequently, an aqueous solution containing 50 g of calcium chloride per 1 liter of water was jetted at a rate of 0.05 liters per minute from another nozzle [5*b*] in a separate line. According to this cooling procedure, an iron oxalate film was initially formed on the surface of the test piece [1], on which a calcium oxalate film was formed.

On the other hand, in the comparative test corresponding to a prior conventional rolling method, city service water was used as the cooling water [4] and jetted from the nozzle [5*b*] at a rate of 0.1 liter per minute.

Figure 11B:
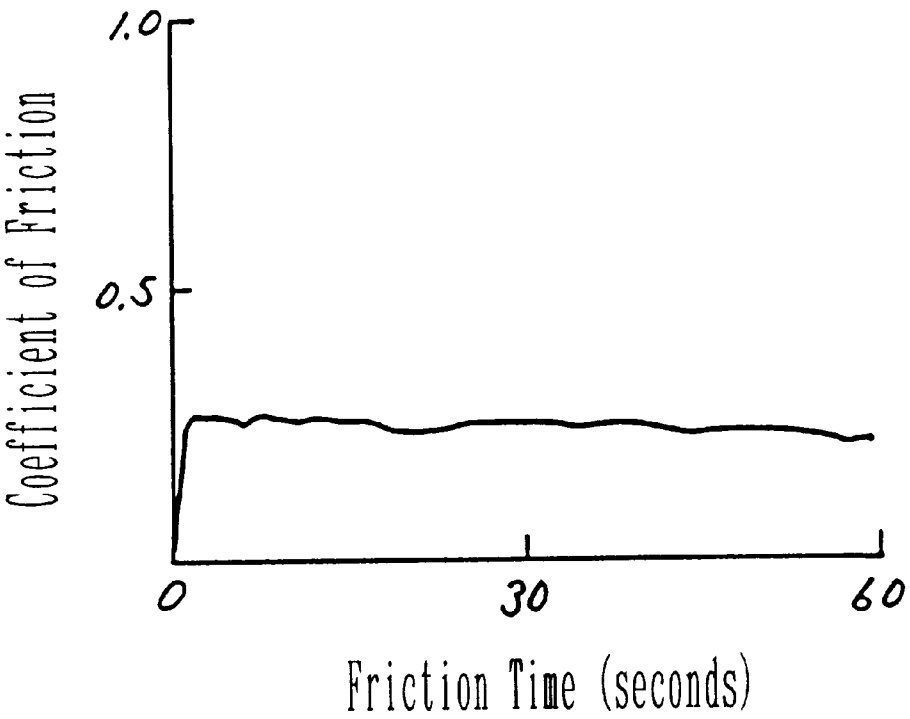
FIG. 11B is a graph showing the results of the evaluation of a friction characteristic in the friction test for Example 4 where the test piece corresponding to a roll has been formed with the film consisting of a mixture of iron oxalate and calcium oxalate as an oxalate film.
Figure 11A:
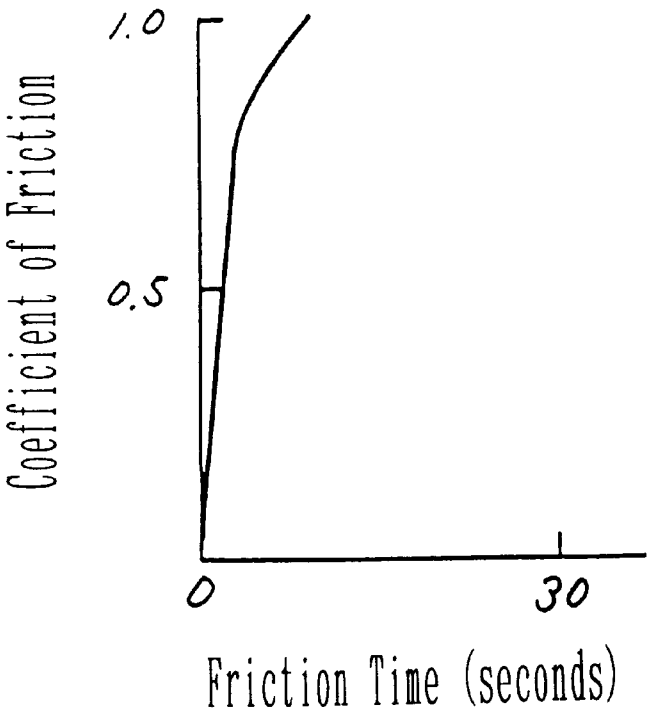
FIG. 11A is a graph showing the results of the evaluation of a friction characteristic in the friction test for Example 4 where the test piece corresponding to a roll has not been subjected to the formation of any film.

In FIGS. 11A and 11B, the results of the friction tests conducted under the above-stated conditions are shown. FIG. 11A shows the results of the comparative test where the test piece [1] corresponding to a roll was not subjected to the formation of any film. On the other hand, FIG. 11B shows the results of the evaluation of the friction characteristic in the test of the present invention method wherein the test piece [1] was formed with the film of the mixture consisting of iron oxalate and calcium oxalate on the surface.

In the case of the comparative method (FIG. 11A), the seizure took place violently from immediately after commencement of the frictional contact. In the method of the present invention wherein the test piece was formed with the film of the mixture consisting of iron oxalate and calcium oxalate on the surface (FIG. 11B), the seizure could be prevented.

Example 5

Figure 12:
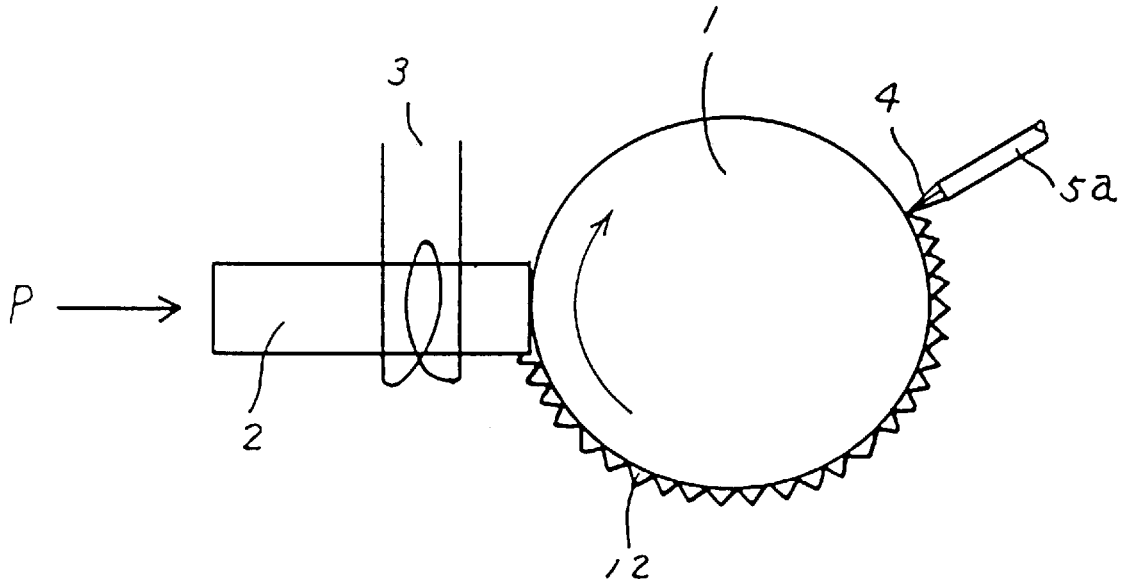
FIG. 12 is a view showing a method of evaluating a friction characteristic according to a "cylinder-block system" used in Example 5.

A friction test was conducted under conditions indicated in FIG. 7 using a "cylinder-block system" shown in FIG. 12. The test method and conditions were the same as those of Examples 3 and 4 except that the feed of cooling water [4] for the test piece [1] corresponding to a roll was in a different way as set out below.

In the test, according to the method of the present invention, an aqueous oxalic acid solution having a concentration of 50 g of oxalic acid ($C_2H_2O_4$) per 1 liter of water was jetted from a nozzle [5*a*] at a rate of 0.1 liter per minute as cooling water [4] for the test piece [1]. On the other hand, in the comparative test corresponding to a prior conventional rolling method, city service water was used as the cooling water [4] and jetted from the nozzle [5*a*] at a rate of 0.1 liter per minute.

Figure 13B:
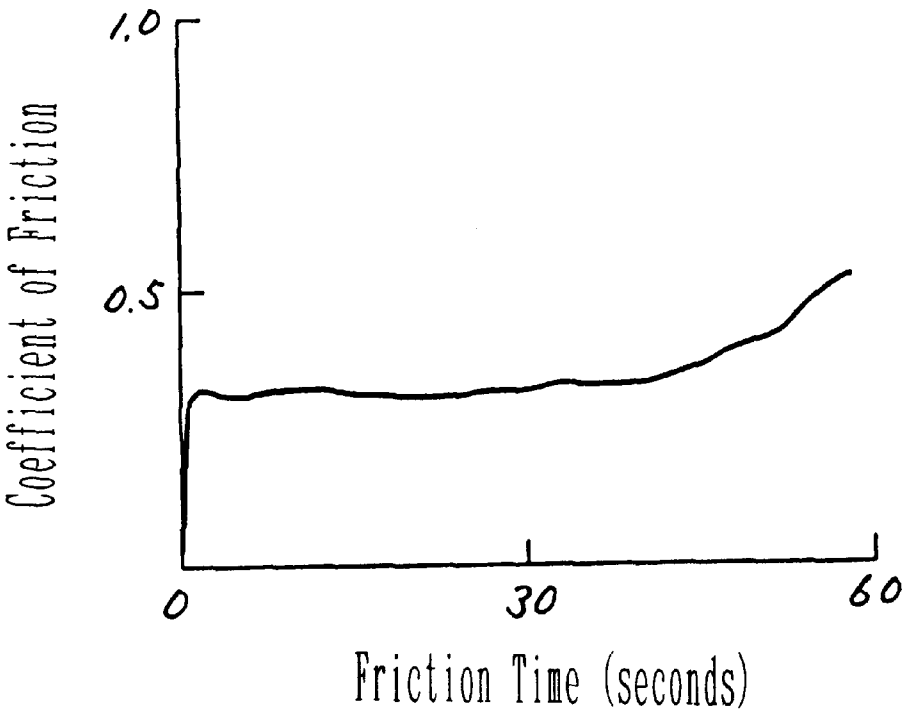
FIG. 13B is a graph showing the results of the evaluation of a friction characteristic in the friction test for Example 5 where the test piece corresponding to a roll has been formed with the film of iron oxalate as an oxalate film.
Figure 13A:
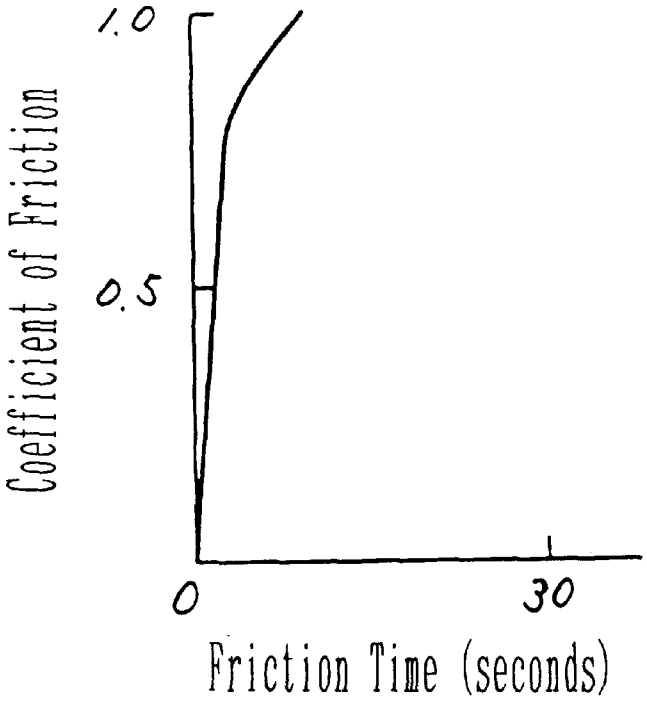
FIG. 13A is a graph showing the results of the evaluation of a friction characteristic in the friction test for Example 5 where the test piece corresponding to a roll has not been subjected to the formation of any film.

In FIGS. 13A and 13B, the results of the friction tests conducted under the above-stated conditions are shown. FIG. 13A shows the results of the comparative test where the test piece [1] corresponding to a roll was not subjected to the formation of any film. On the other hand, FIG. 13B shows the results of the evaluation of the friction characteristic in the test of present invention method wherein the test piece [1] was formed with the iron oxalate film on the surface.

In the case of the comparative method (FIG. 13A), the seizure took place violently from immediately after commencement of a frictional contact. In the method of the present invention wherein the iron oxalate film was formed on the surface of the test piece (FIG. 13B), the time before the seizure took place could be delayed extremely.

Example 6

A friction test was conducted under conditions indicated in FIG. 7 using a "cylinder-block system" shown in FIG. 8. The test method and conditions were the same as those of Examples 3~5 except that the feed of cooling water [4] for the test piece [1] corresponding to a roll was in a different way as set out below.

In the test, according to the method of the present invention, an aqueous oxalic acid solution having a concentration of 50 g of potassium oxalate per 1 liter of water, and an aqueous solution containing 50 g of calcium chloride per 1 liter of water were, respectively, fed as cooling water [4] for the test piece [1] from separate nozzles [5*a*] and [5*b*]. These aqueous solutions were, respectively, jetted at a rate of 0.05 liters/minute simultaneously at the same portion (position) immediately before the frictional contact between the test pieces [1] and [2].

On the other hand, in the comparative test corresponding to a prior conventional rolling method, city service water was used as the cooling water [4] and jetted from the nozzle [5*a*] at a rate of 0.1 liter per minute immediately before the frictional contact between the test pieces [1] and [2].

Figure 14B:
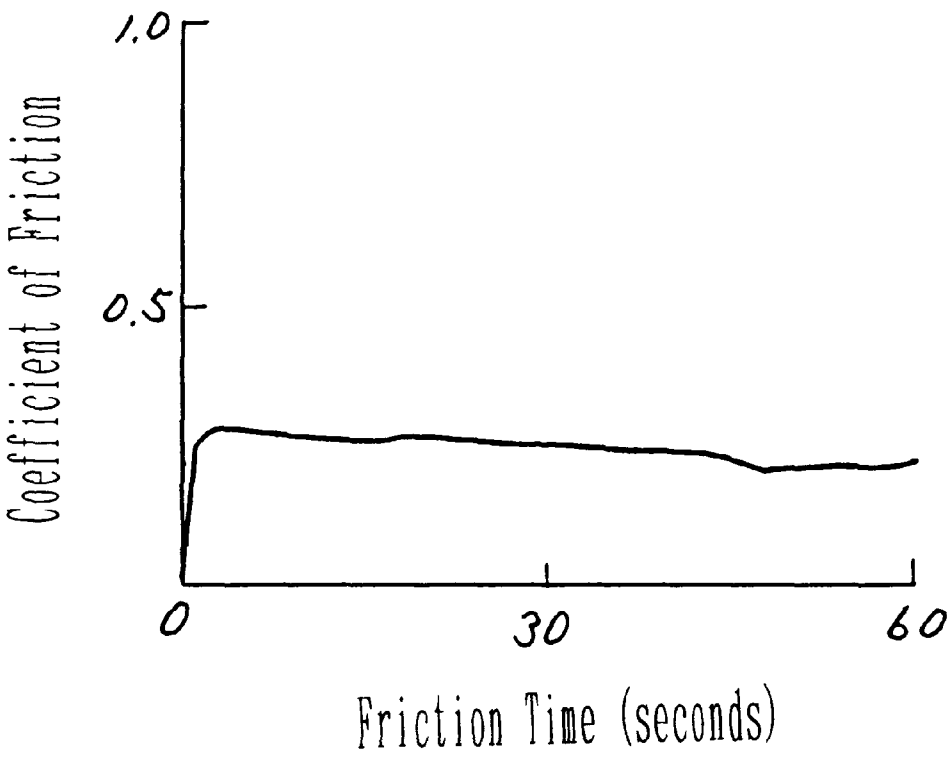
FIG. 14B is a graph showing the results of the evaluation of a friction characteristic in the friction test for Example 6 where the test piece corresponding to a roll has been formed with the film of calcium oxalate as an oxalate film.
Figure 14A:
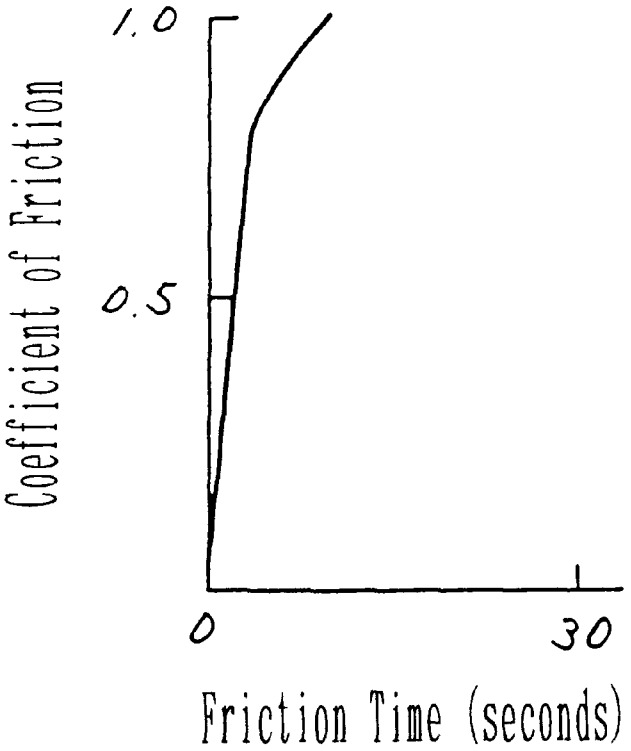
FIG. 14A is a graph showing the results of the evaluation of a friction characteristic in the friction test for Example 6 where the test piece corresponding to a roll has not been subjected to the formation of any film.

In FIGS. 14A and 14B, the results of the friction tests conducted under the above-stated conditions are shown. FIG. 14A shows the results of the comparative test where the test piece [1] corresponding to a roll was not subjected to the formation of any film. On the other hand, FIG. 14B shows the results of the evaluation of the friction characteristic in the test of the present invention method wherein the test piece [1] was formed with the calcium oxalate film on the surface.

In the case of the comparative method (FIG. 14A), the seizure took place violently from immediately after commencement of the frictional contact. In the method of the present invention wherein the calcium oxalate film was formed on the surface of the test piece (FIG. 14B), the seizure could be prevented.

In the above-mentioned examples, an oxalate film was formed on the surface of a test piece corresponding to a hot rolling roll to evaluate an anti-seizing property on a laboratory scale. The following examples illustrate tests using a rolling mill line.

Example 7

In order to more clearly confirm the effects of the present invention, according to the rolling method of the present invention, a rolling test using hot rolling rolls which were formed with an oxalate film on the surfaces was conducted. In the test, finish rolling rolls of a universal rolling mill which was used for the manufacture of steel sections were selected as a test device. A steel product [8] to be rolled was rolled through a pair of upper and lower horizontal rolls [6] and a pair of right and left vertical rolls [7]. The rolls [6] and [7], made of nickel grain iron as a stock, which had been dressed on the surface by lathing and polished with a grinder were provided as test rolls. The steel product [8] to be rolled was made of SUS 304.

Figures 15, 16:
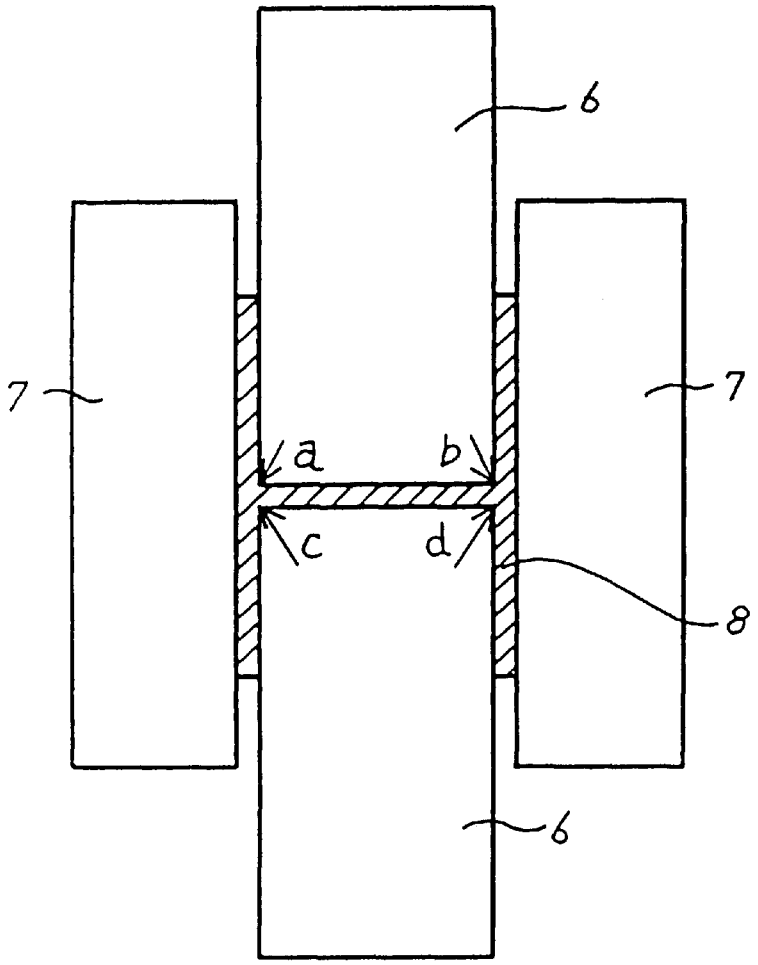
FIG. 15 is a view showing the flow of cooling water to rolls capable of shaping a flange at the time of a line test using a rolling mill.
FIG. 16 is a table showing the conditions of a line test using a rolling mill.
Figure 17:
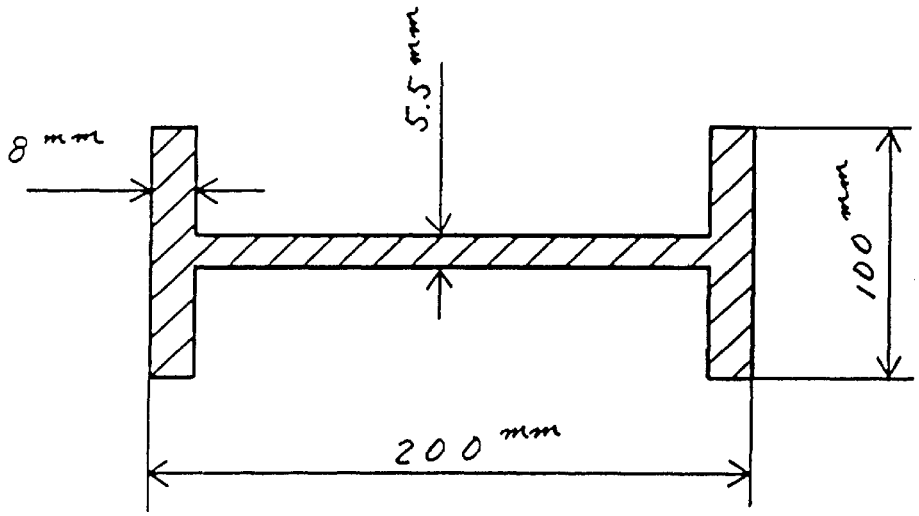
FIG. 17 is a view showing a product profile rolled by the rolling test.

In the rolling method of the present invention, an aqueous oxalic acid solution was fed to the surfaces of the rolls [6] and [7] as shown in FIG. 15. That is, an aqueous oxalic acid solution having a concentration of 30 g of oxalic acid ($C_2H_2O_4$) per 1 liter of water was jetted against flange-constituting roll portions [a]~[d] of the respective rolls, by use of nozzles at a rate of 1 liter per minute just prior to rolling. For comparison, rolling by a prior conventional rolling method was conducted by jetting ordinary industrial water against the above-mentioned portions [a]~[d] at a rate of 10 liters per minute. In FIG. 16, line test conditions of the rolling mill are shown. FIG. 17 shows the profile of a steel product.

The line test was conducted under the above-stated conditions. As a result, it was found that in case of the prior conventional rolling method, scratches (the seizure) in the form of a crescent moon were observed at the flange portions of the product from the first cycle of rolling. The wear of the rolls and deterioration of both the rolls and the product were recognized. In contrast, according to the rolling method of the present invention, the ratio of the occurrence of the scratching was 10% or less.

In addition, carbon steels and low alloy steels as the steel product [8] to be rolled were also rolled under the same conditions described abobe. As a result, according to the rolling method of the present invention, no scratching was recognized after the total rolling amount reached 100 tons.

Example 8

According to the rolling method of the present invention, a rolling test was conducted wherein a film consisting of a mixture of iron oxalate and calcium oxalate was formed on the surfaces of hot rolling rolls as an oxalate film. In this rolling test, finish rolling rolls of a universal rolling mill which was used for the manufacture of steel sections were selected as a test device.

The testing rolls and the steel product to be rolled were the same as those of Example 7. In particular, the rolls [6] and [7], made of nickel grain iron as a stock, which had been dressed on the surface by lathing and polished with a grinder were used, and the steel product [8] to be rolled was made of SUS 304.

Figure 18:
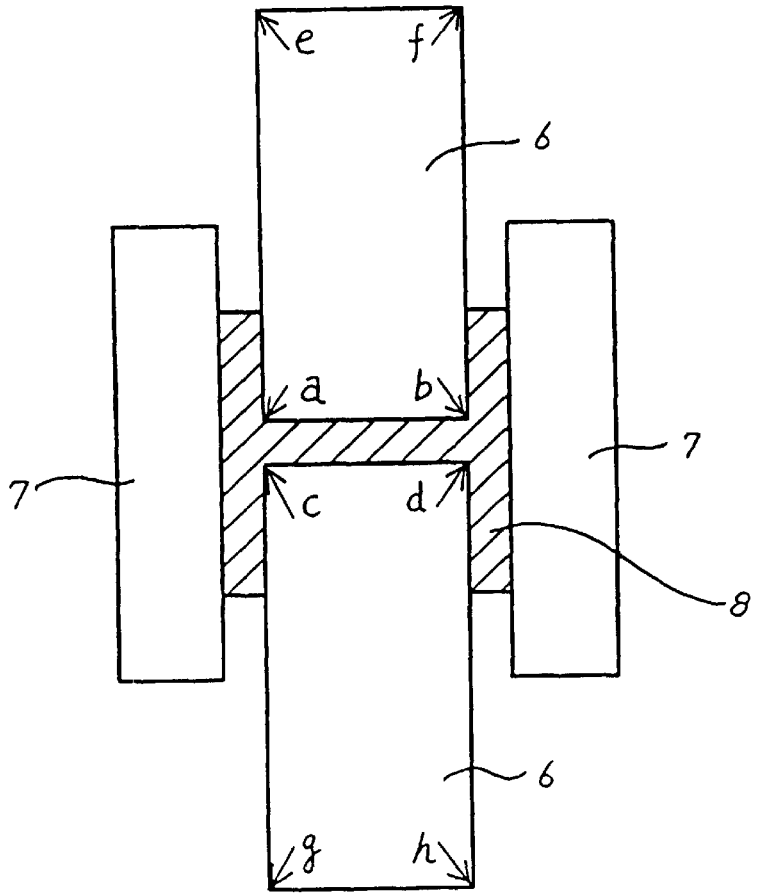
FIG. 18 is another view showing the flow of cooling water to rolls capable of shaping a flange at the time of a line test using a rolling mill.

In the rolling method of the present invention, the cooling water was fed to the surfaces of the rolls [6] and [7] in a manner as shown in FIG. 18. In particular, an aqueous oxalic acid solution having a concentration of 50 g of oxalic acid ($C_2H_2O_4$) per 1 liter of water and an aqueous solution containing 50 g of calcium chloride per 1 liter of water were, respectively, jetted against flange-constituting roll portions [a]~[d] of the respective rolls from nozzles in separate lines at a rate of 1 liter per minute just prior to rolling. Likewise, an aqueous oxalic acid solution having such a concentration as indicated above was jetted against flange-constituting roll portions [e]~[h] at a rate of 1 liter per minute just prior to rolling.

According to this roll cooling method, a film consisting of a mixture of iron oxalate and calcium oxalate could be formed on the roll surfaces as an oxalate film.

For comparison, rolling by a prior conventional rolling method was conducted by jetting ordinary industrial water against the flange-constituting portions [a]~[d] at a rate of 10 liters per minute. In FIG. 19, line test conditions of the rolling mill are shown. The profile of a steel product is shown in FIG. 17.

The line test was conducted under the above-stated conditions. As a result, it was found that in case of the prior conventional rolling method, scratches (the seizure) in the form of a crescent moon were observed at the flange portions of the product from the first cycle of rolling. The wear of the rolls and deterioration of both the rolls and the product were recognized.

In contrast, according to the rolling method of the present invention, no scratch was recognized. In addition, little wear of the rolls were found and no deterioration of both the rolls and the product was found after the total rolling amount reached 100 tons.

As shown in above-mentioned examples, according to the hot rolling method of the present invention, the seizure of the rolls can be prevented at the time of the rolling of steel sections. In addition, the wear of the rolls can be suppressed while preventing the deterioration of both the rolls and the steel products to be rolled. It was confirmed that the effect produced by the formation of an oxalate film was shown not only on the rolling of the H beams, but also on the rolling of other types of steel sections. Similar effects were obtained on the hot rolling of steel bars, steel plates, steel sheets in coil, steel tubes, steel flats, and steel wire rods.

It should be noted that it was confirmed that similar results, as with the case of "calcium" having set out herein, were obtained when using "barium" or "strontium" as an "alkaline-earth metal".

Possibility of Industrial Application

Using hot rolling rolls with the present invention, the seizure, the wear of the rolls and the deterioration of both the rolls and the steel products to be rolled can be prevented, as would be otherwise caused at the time of hot rolling steel products. The roll is inexpensive and is obtained by a simple process.

Furthermore, when a hot rolling method using the present invention is carried out wherein rolls, which have been preliminarily immersed in an aqueous oxalic acid solution, are used for rolling, or rolls are subjected to on-line spraying on the surfaces, thereby, under above-mentioned appropriate conditions with an aqueous oxalic acid solution or an aqueous solution containing a water-soluble oxalate (e.g. an alkali metal oxalate, ammonium oxalate and the like), and also with an aqueous solution containing a water-soluble calcium compound are used for rolling, the seizure can be avoided. At the time when various types of steel products including, H beams which have flange portions, are rolled, then, the surface conditions of the rolled products are remarkably improved.

The hot rolling, according to the method of the present invention is able to significantly prolong the roll life (i.e. the time before a change of rolls to fresh ones). The prolongation of the roll life has a great economical effect. The frequency of repairing the rolls is reduced, with a greatly improved working efficiency.

If lubricating oils are used, waste water treatment equipment becomes necessary, hence, it is necessary to invest in the treatment equipment. According to the present invention, the seizing-preventing effect is similar to or greater than that of oils, with the additional merit that no waste water treatment equipment is necessary. Thus, the present invention has great industrial applicability.

What is claimed is:

1. A method for the hot rolling of steel products which comprises forming an iron oxalate film on the roll surfaces which have contact with the steel products to be rolled, by immersing hot rolling rolls for the steel products in an aqueous oxalic acid solution, or coating or spraying an aqueous oxalic acid solution over the rolls, and subjecting the steel products to hot rolling with the rolls on which said iron oxalate film forms.

2. A method for the hot rolling of steel products which comprises using an aqueous oxalic acid solution as a part or all of the cooling water for hot rolling rolls for the steel products, and rolling the steel products while forming an iron oxalate film on the roll surfaces which have contact with the steel products to be rolled.

3. A method for the hot rolling of steel products which comprises using, as a part or all of the cooling water for hot rolling rolls for the steel products, an aqueous oxalic acid solution or an aqueous solution containing a water-soluble oxalate, and an aqueous solution containing a water-soluble alkaline-earth metal compound, and rolling the steel products while forming an oxalate film on the roll surfaces which have contact with the steel products to be rolled.

4. The method for the hot rolling of steel products according to claim 3, wherein, the said oxalate film is an alkaline-earth metal oxalate film.

5. The method for the hot rolling of steel products according to claim 3, wherein, the said oxalate film is a mixed salt film of iron oxalate and an alkaline-earth metal oxalate.

6. The method for the hot rolling of steel products according to claim 3, wherein, the said oxalate film is a calcium oxalate film.

7. The method for the hot rolling of steel products according to claim 3, wherein, the said oxalate film is a mixed salt film of iron oxalate and calcium oxalate.

8. A hot rolling roll for steel products which comprises having an oxalate film on the roll surfaces which have contact with the steel products to be rolled.

9. The hot rolling roll for steel products according to claim 8, wherein, the said oxalate film is an iron oxalate film.

10. The hot rolling roll for steel products according to claim 8, wherein, the said oxalate film is an alkaline-earth metal oxalate film.

11. The hot rolling roll for steel products according to claim 8, wherein, the said oxalate film is a mixed salt film of iron oxalate and an alkaline-earth metal oxalate.

12. The hot rolling roll for steel products according to claim 8, wherein, the said oxalate film is a calcium oxalate film.

13. The hot rolling roll for steel products according to claim 8, wherein, the said oxalate film is a mixed salt film of iron oxalate and calcium oxalate.

14. The method for the hot rolling of steel products according to claim 3, wherein the aqueous solution containing a water-soluble alkaline-earth metal compound contains at least 20 ppm of Ca ions, Ba ions or mixtures thereof.

15. The method for the hot rolling of steel products according to claim 1, wherein the hot rolling rolls are coated with calcium oxalate and the calcium oxalate is thermally decomposed into calcium carbonate as a result of contact with the steel products during hot rolling of the steel products, the calcium oxalate being in the form of particles having a diameter of 0.3 to 20 $\mu$m.

16. The method for the hot rolling of steel products according to claim 1, wherein the iron oxalate film is thermally decomposed into iron oxide as a result of contact with the steel products during hot rolling of the steel products, the iron oxide preventing seizure between the steel products and the hot rolling rolls during hot rolling of the steel products.

17. The method for the hot rolling of steel products according to claim 1, wherein the aqueous oxalic acid solution has a concentration of 10 to 100 g/l of oxalic acid.

18. The method for the hot rolling of steel products according to claim 3, wherein the aqueous solution containing a water-soluble oxalate has a concentration of 10 to 100 g/l of a water-soluble oxalate and the aqueous solution containing a water-soluble alkaline-earth metal compound has a concentration of 10 to 100 g/l of a calcium compound.

19. The hot rolling roll for steel products according to claim 8, wherein the iron oxalate film has a thickness of 10 to 25 $\mu$m, the iron oxalate film being combined with a calcium oxalate film having a thickness of 80 to 100 $\mu$m.

20. The hot rolling roll for steel products according to claim 8, wherein the hot rolling roll is of an iron-based material having at least 70 wt % Fe and the oxalate film is effective to prevent seizing between the roll surfaces and steel products during hot rolling thereof, the oxalate film being thermally decomposable into a calcium carbonate film during hot rolling of steel products with the rolling roll or the oxalate film being thermally decomposable into an iron oxide film during hot rolling of steel products with the hot rolling roll, the iron oxalate film having a thickness of 10 to 25 $\mu$m.

* * * * *